US007063589B2

(12) United States Patent
Matsukawa et al.

(10) Patent No.: US 7,063,589 B2
(45) Date of Patent: Jun. 20, 2006

(54) REMOTE CONTROL TOY TOP

(75) Inventors: Hiroyuki Matsukawa, Tokyo (JP); Tatsuya Hocho, Tokyo (JP); Jintei Choh, Chiba (JP)

(73) Assignees: Takara Co., Ltd., Tokyo (JP); Xenoid Protodesign Co., Ltd., Chiba (JP)

( * ) Notice: Subject to any disclaimer, the term of this patent is extended or adjusted under 35 U.S.C. 154(b) by 76 days.

(21) Appl. No.: 10/413,118

(22) Filed: Apr. 14, 2003

(65) Prior Publication Data

US 2003/0199222 A1 Oct. 23, 2003

(30) Foreign Application Priority Data

Apr. 17, 2002 (JP) ..... 2002-115408

(51) Int. Cl.
*A63H 1/06* (2006.01)

(52) U.S. Cl. ..... 446/256; 446/259

(58) Field of Classification Search ..... 446/256–264, 446/175, 454, 456, 233
See application file for complete search history.

(56) References Cited

U.S. PATENT DOCUMENTS

| | | | | |
|---|---|---|---|---|
| 1,856,514 | A | 5/1932 | Sheneman | |
| 2,832,177 | A | 4/1958 | Mueller | |
| 3,082,574 | A | 3/1963 | Hellman | |
| 3,224,142 | A | 12/1965 | Pawelka et al. | |
| 3,246,427 | A | 4/1966 | Tuuri | |
| 3,253,365 | A * | 5/1966 | Calderon | 446/259 |
| 3,254,446 | A * | 6/1966 | Endris | 446/138 |
| 3,623,262 | A | 11/1971 | Noda | |
| 3,629,680 | A | 12/1971 | Baynes et al. | |
| 3,970,309 | A | 7/1976 | Sato | |
| 4,090,715 | A * | 5/1978 | Wagner et al. | 446/259 |
| 4,636,178 | A | 1/1987 | Oda | |
| 4,697,133 | A | 9/1987 | Pergandis | |
| 5,024,625 | A * | 6/1991 | MacCarthy | 446/259 |
| 5,334,075 | A * | 8/1994 | Kakizaki et al. | 446/456 |
| 5,593,338 | A * | 1/1997 | Itoh et al. | 446/259 |
| 6,089,946 | A * | 7/2000 | Yang | 446/259 |
| 6,458,008 | B1 | 10/2002 | Hyneman | |
| 2003/0040255 | A1 * | 2/2003 | Hauptner et al. | 446/484 |

FOREIGN PATENT DOCUMENTS

| | | | |
|---|---|---|---|
| JP | 10076074 | A | 3/1998 |
| JP | 2002000962 | A | 1/2002 |
| KR | 2002020561 | A | 3/2002 |

OTHER PUBLICATIONS

Hasbro, Internet: www.hasbro.com, press release, "Beyblade tops, the number-one, authentic high-performance tops, spin to the line in 2003", 2003.*

(Continued)

*Primary Examiner*—Kien Nguyen

(57) ABSTRACT

A remote control toy top, which is capable of remotely controlling performance characteristics of a toy top spinning on a stadium and freely changing performance characteristics, is provided. The remote control toy top is composed of the toy top and a remote controller device for remotely controlling the performance characteristics of the toy top. The toy top is provided with a motor, and regular and reverse rotation of the motor is controlled by a control signal generated from the remote controller device, and a shaft body of the toy top is rotated in cooperation with a motor shaft of the motor.

20 Claims, 9 Drawing Sheets

OTHER PUBLICATIONS

Funkyzilla, Internet: www.funkyzilla.com, "Remote Controlled Beyblade Dragoon", 2003.*
Hasbro, Internet: www.hasbro.com, "Beyblade Products", 2003.*
MK Toys, Internet: www.mktoys.com, "Remote Control Spinning Top", 2003.*
Yahoo! Shopping, Internet: shopping.yahoo.com, battle top, 2003.*

* cited by examiner

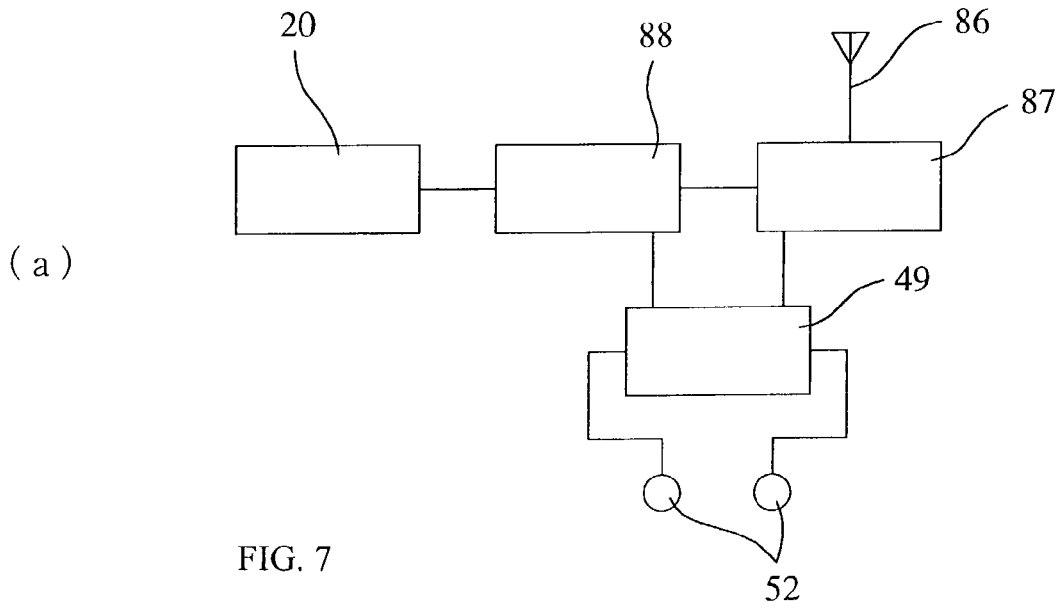
FIG. 7
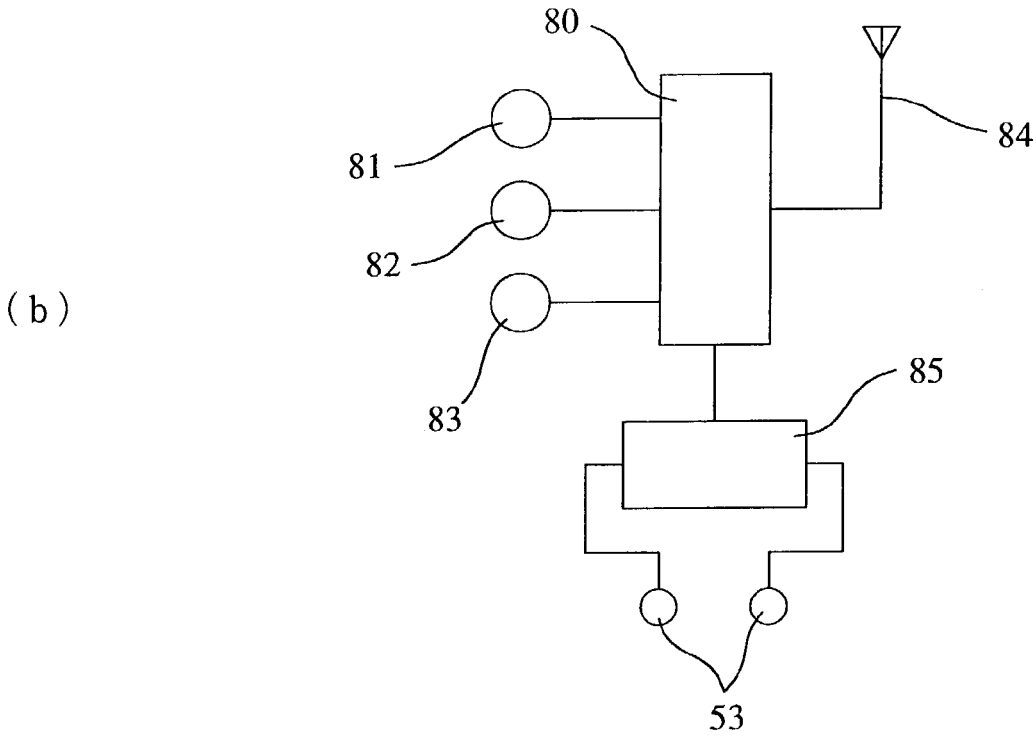

(a)

(b)

(a)
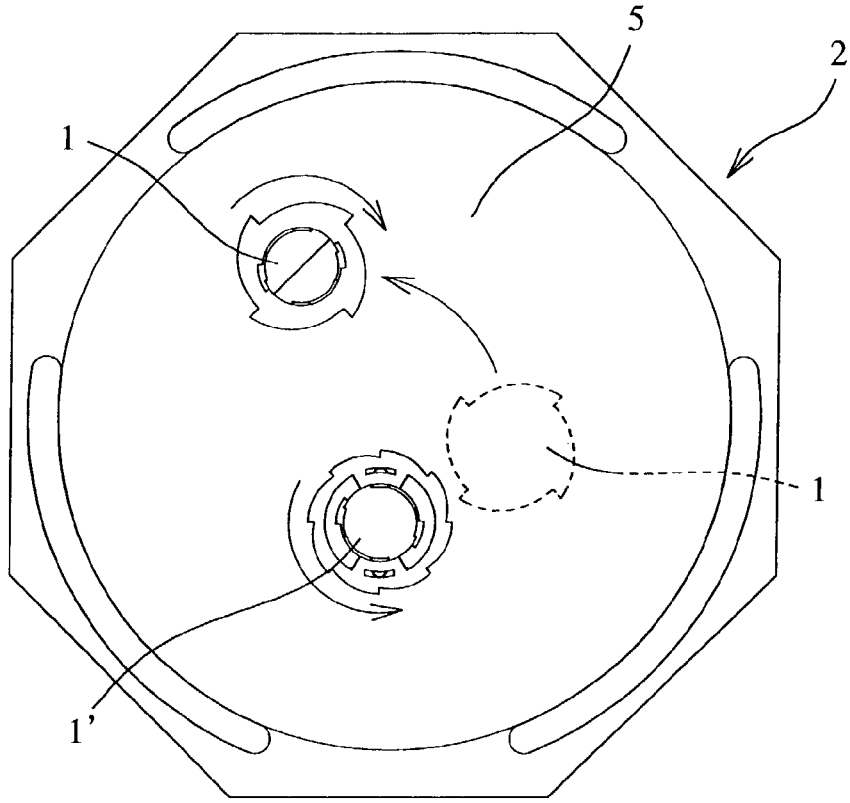
FIG. 9
(b)
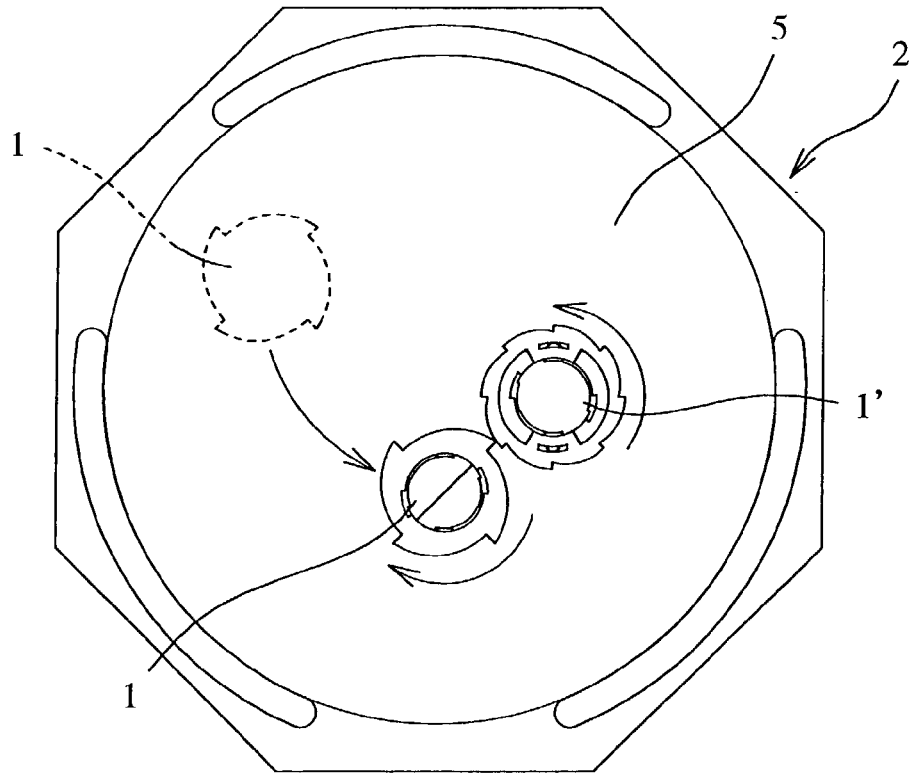

REMOTE CONTROL TOY TOP

BACKGROUND OF THE INVENTION

1. Field of the Invention

The present invention relates to a remote control toy top. More specifically the invention relates to the remote control toy top which is capable of changing the performance characteristics of a spinning toy top by remote control.

2. Description of the Related Art

Conventionally, a lot of users enjoy a toy top game in which the users spin a plurality of toy tops on a game board and strike their toy tops against those of their companions. Toy top games in which the shape and function of their toy tops are changed have been popularized.

However, when players release conventional toy tops, they cannot intervene in the game, but instead only watch the progress of the game.

SUMMARY OF THE INVENTION

It is an object of the present invention to solve the above problem and provide a remote control toy top in which performance characteristics of the toy top spinning on a stadium can be controlled by remote operation and can be changed freely.

In order to solve the above problem, a remote control toy top according to the present invention comprising a toy top and a remote controller device for changing performance characteristics of the toy top by means of a remote operation, is characterized in that:

(a) the toy top is provided with a motor and the motor is rotated regularly and reversely by a control signal generated from the remote controller device; and (b) a shaft body of the toy top is rotatably supported on a bottom portion of a toy main body so as to be capable of rotating in cooperation with a motor shaft of the motor.

Here, it is preferable that the shaft body of the toy top includes a buffer mechanism for absorbing an impact in an up-down direction so that an impact is not applied to the motor.

In addition, it is preferable that the toy top competes against other toy tops in a stadium device formed by curving its upper surface into a concave mirror shape.

Moreover, the remote controller device may be provided with a starter mechanism for giving an initial spin to the toy top.

Further, the toy top is provided detachably with an attack ring which attacks other toy tops on an upper surface of the toy main body, and at least two hangover portions protrusively formed on the attack ring at equal intervals in a peripheral direction so that an attack force against the competitor's toy tops is increased.

BRIEF DESCRIPTION OF DRAWINGS

FIGS. 7(*a*) and 7(*b*) are block diagrams of the toy top and the remote controller device.

FIGS. 9(*a*) and 9(*b*) are plan views showing performance characteristics of the toy top spinning on the stadium.

DETAILED DESCRIPTION OF THE PREFERRED EMBODIMENTS

Figure 1:
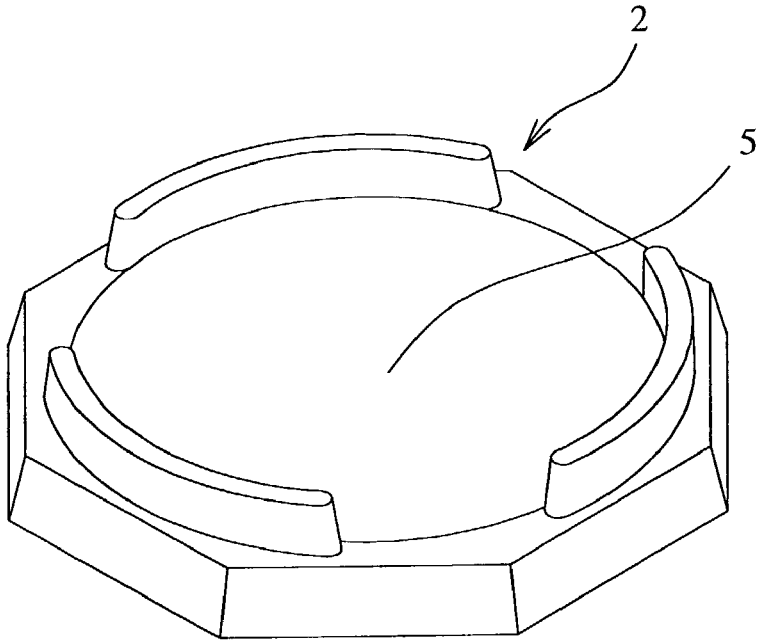
FIG. 1 is a perspective view showing a structure of a remote control toy top according to the present invention.
Figure 1:
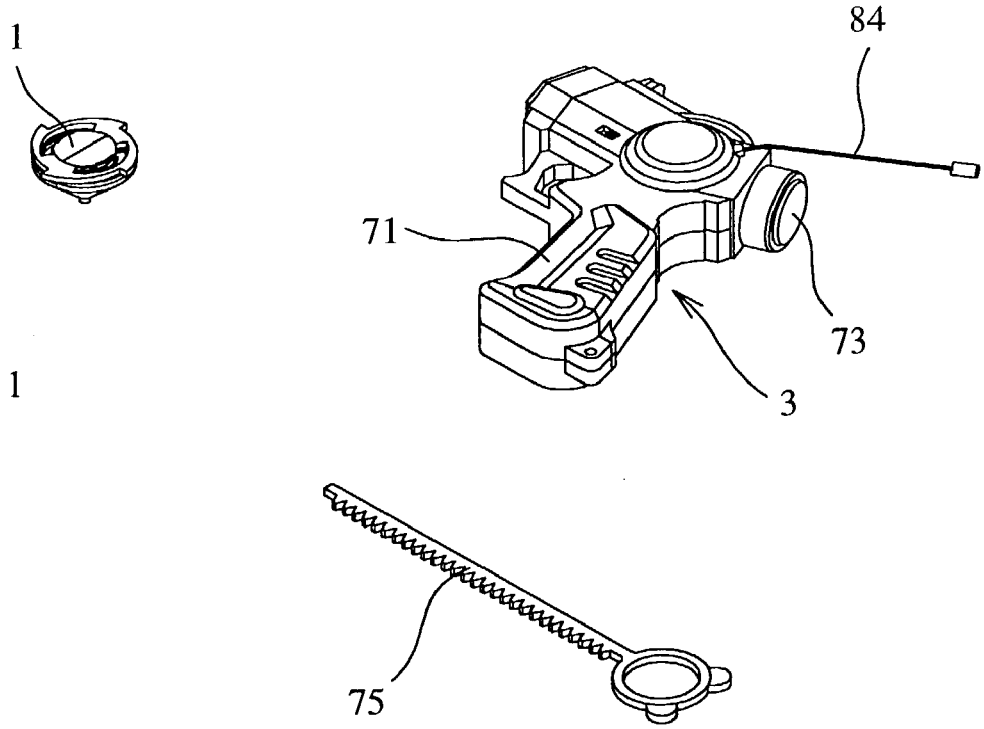

FIG. 1 shows a perspective view explaining one example of a structure of a remote control toy top according to the present invention. The remote control toy top is composed of a toy top 1, a stadium 2 on which the toy top 1 is spun, and a remote controller device 3 for remotely controlling the performance characteristics of the toy top 1. The remote controller device 3 has a starter mechanism 4 for giving an initial spin to the toy top 1.

The stadium 2 has a game surface 5 formed by curving an upper surface of the stadium 2 downward into a concave mirror shape. When a spinning speed of the toy top 1 is high, the toy top 1 is spinning and simultaneously moves towards an outer peripheral direction on the game surface. When the spinning speed of the toy top 1 is low, it can move towards the center of the game surface.

Figure 2:
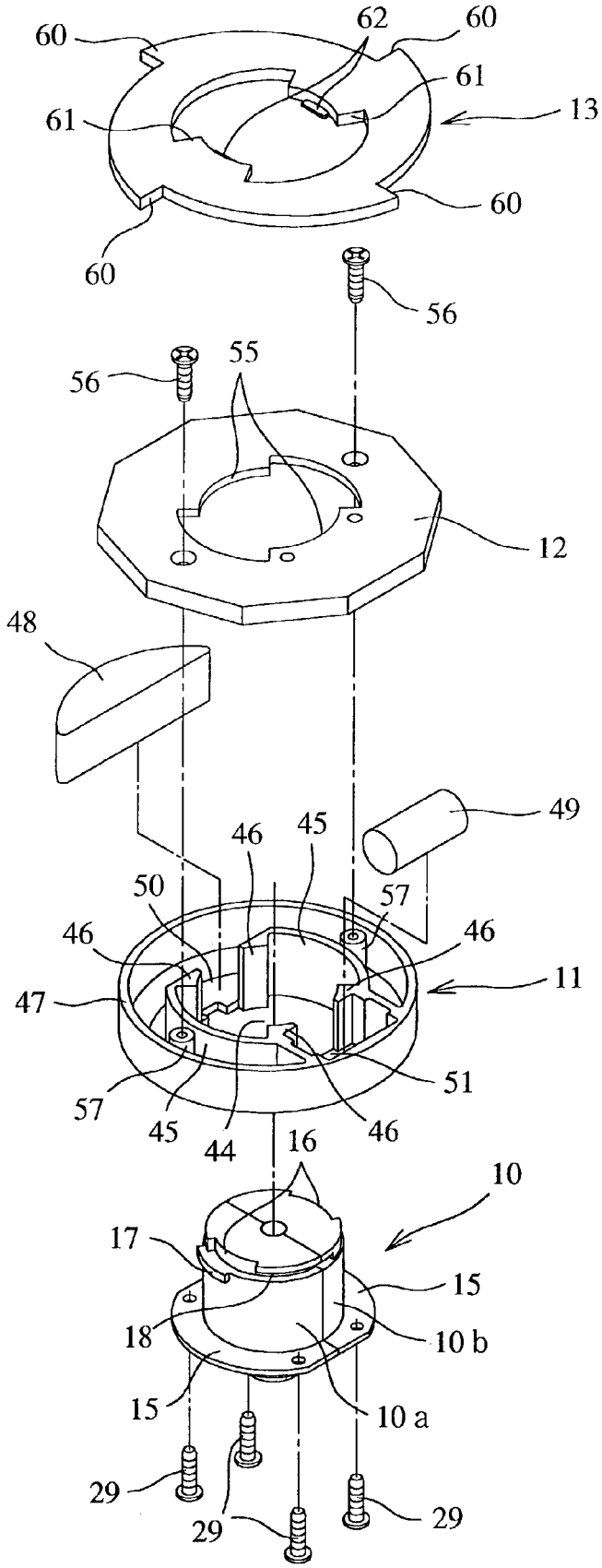
FIG. 2 is an exploded perspective view showing the structure of the toy top.

The toy top 1, as shown in FIG. 2, is integrated with a main body or base member 11, a shaft support 10 and a lid 12. The toy top 1 is provided detachably with an attack ring 13.

The shaft support 10 is formed into an approximately cylindrical shape by combining divided supports 10*a* and 10*b*, and it can accommodate a motor 20 and a buffer mechanism 25, described later, therein. Overhang portions 15, 15 are protrusively formed on a lower portion of the peripheral surface of the shaft support 10. The shaft support 10 is inserted into the base member 11 from below, and can be fixed to the base member 11 by screws 29 in a state that the overhang portions 15, 15 come in contact with the bottom surface of the base member 11.

Notch portions 16, 16 are formed on both side surfaces of an upper end of the shaft support 10, and supporting pieces 17 are formed on lower portions of the notch portions 16, 16 respectively. Attachment groove 18 is formed, in a counter-clockwise direction, on each of the peripheral surfaces of the notch portions 16 so as to extend to the vicinity of the other notch portion 16.

Figure 3:
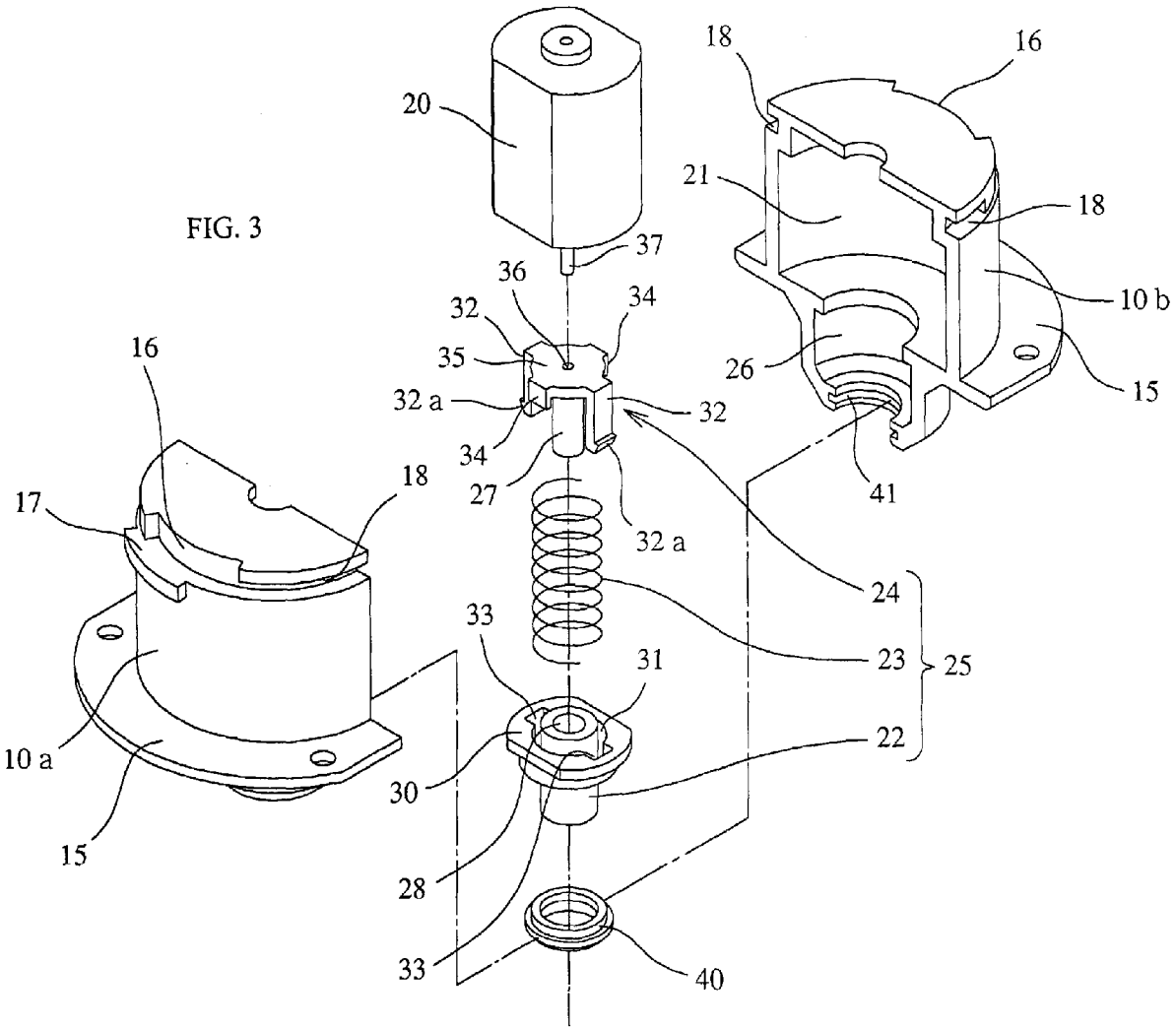
FIG. 3 is an exploded perspective view showing a structure of a rotary shaft body.

As shown in FIG. 3, the inside of the shaft support 10 is formed with a first accommodating section 21 which accommodates the motor 20 and a second accommodating section 26 which accommodates the buffer mechanism 25.

The buffer mechanism 25 is composed of a shaft body 22 and a coil spring 23 and a holding member 24 for holding the coil spring 23 to the shaft body 22. An upper surface of the shaft body 22 is provided with an insertion hole 28 into which a shaft portion 27 of the holding member 24 is inserted, and the shaft body 22 can move up and down with respect to the holding member-24.

The upper portion of the shaft body 22 protrudes outward so as to be formed with a flange portion 30, and the flange portion 30 is provided with a ring-shaped accommodating groove 31 which accommodates the lower portion of the coil spring 23. Further, through holes 33 via which hooks 32 formed on the holding member 24 are inserted are formed on both ends of the accommodating groove 31 so as to connect with each other. The through holes 33 penetrate the flange portion 30 to open on the lower surface of the flange portion 30.

The holding member 24 is formed with the shaft portion 27 which protrudes downwardly from the center of the lower surface of a disc 35 having a slightly larger diameter than that of the coil spring 23. The hooks 32, 32 protrude downwardly from both ends of the disc 35, and protruded pieces 34, 34 protrude downwardly so as to intersect perpendicularly the hooks 32, 32. The protruded pieces 34, 34 are engaged with the upper end of the coil spring 23 so that the upper end of the coil spring 23 does not shift from the disc 35.

The center on the upper surface of the disc 35 is formed with a fitting hole 36 so that the fitting hole 36 extends to the inside of the shaft portion 27. An end of a motor shaft 37 of the motor 20 is fitted into the fitting hole 36, and the buffer mechanism 25 (shaft body 22) rotates in accordance with rotation of the motor shaft 37.

Figure 4:
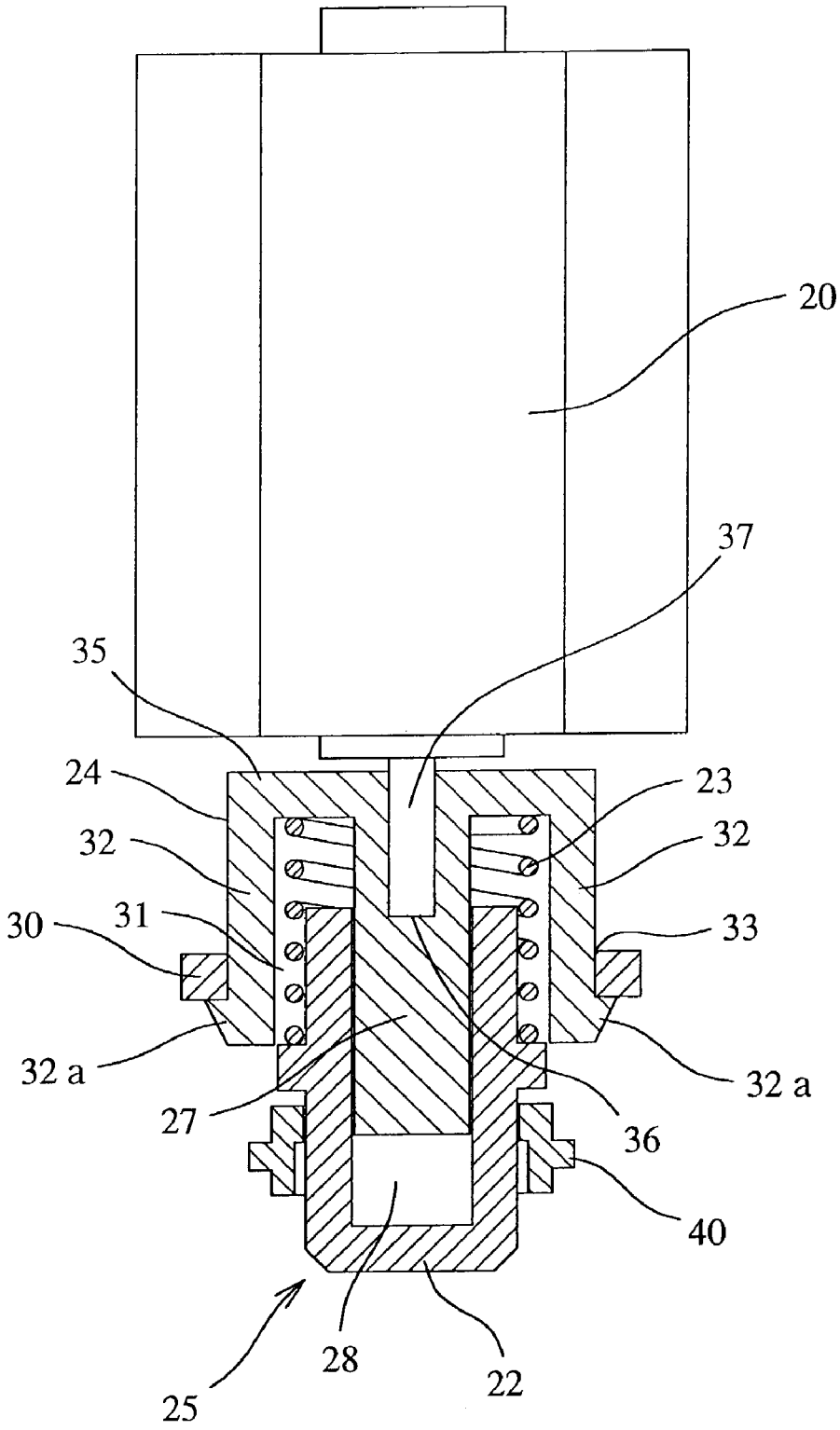
FIG. 4 is a cross-sectional view of a main section showing the structure of the rotary shaft body.

The buffer mechanism 25 is formed in the following manner. The accommodating groove 31 of the shaft body 22 accommodates the lower end of the coil spring 23, and the end of the shaft portion 27 of the holding member 24 is inserted into the insertion hole 28 of the shaft body 22 in a state that the positions of the hooks 32, 32 match with those of the through holes 33, 33. While the coil spring 23 is being compressed, the holding member 24 is pushed into the shaft body 22 until the ends of the hooks 32, 32 penetrate the flange portion 30 of the shaft body 22. When the ends 32*a*, 32*a* of the hooks 32, 32 penetrate the insertion hole 28, the ends 32*a*, 32*a* are engaged with the lower surface of the flange portion 30, and the shaft body 22 is integrated with the holding member 24 in the state that the coil spring 23 is compressed (see FIG. 4).

The motor 20 and the buffer mechanism 25 are constituted integrally in a state that the end of the motor shaft 37 is fitted into the fitting hole 36 of the holding member 24. For this reason, in order to combine the divided supports 10*a*, 10*b*, in a state that a washer 40 is attached to the shaft body 22 and the washer 40 is engaged with an engagement groove 41 of the shaft support 10, the motor 20 is accommodated in the first accommodating section 21 and the buffer mechanism 25 is accommodated in the second accommodating section 26. The divided supports 10*a*, 10*b* in the combined state are inserted into the base member 11, described later, from below, and the buffer mechanism 25 may be fixed to the base member 11 by the screws 29 in the state that the overhang portions 15 come in contact with the bottom surface of the base member 11.

When an impact is applied to the shaft body 22 from below, the shaft body 22 compresses the coil spring 23 and simultaneously moves up and down so that the coil spring 23 absorbs the impact. For this reason, the impact is prevented from being transmitted directly to the motor shaft 37 of the motor 20.

The upper surface of the base member 11 is fully opened and is formed into a thin cylindrical shape in which the center of the bottom surface is opened. Circular arc shaped inner walls 45, 45 are formed on the peripheral edge of a center opening portion 44 so as to be opposed to each other, and nipping protrusions 46, 46 for nipping the buffer mechanism 25 inserted into the opening portion 44 from below in a cylindrical state are protrusively formed on both ends of the inner walls 45.

Figure 5:
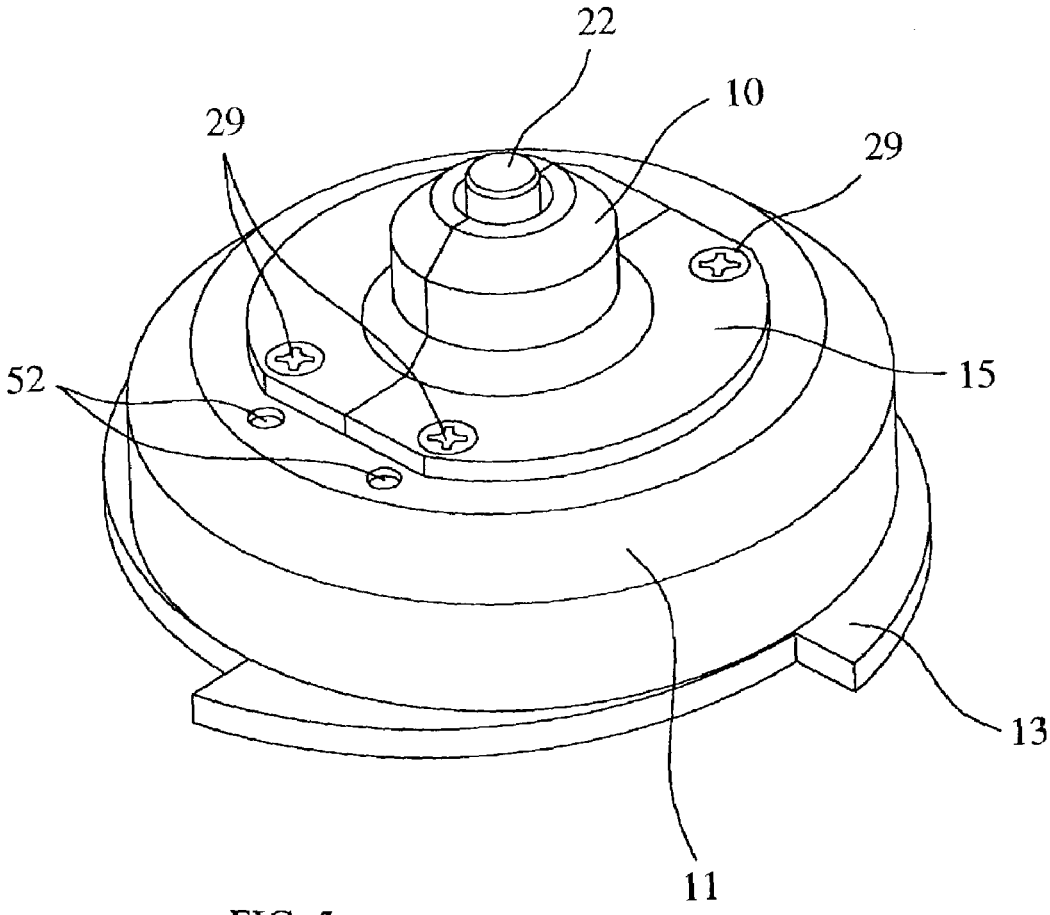
FIG. 5 is a perspective view of a bottom surface of the toy top.

A circuit unit 48 and accommodating sections 50, 51 for accommodating secondary battery (nickel-cadmium battery) 49 are formed between the nipping protrusions 46 and an outer wall 47. Further, two electrodes 52, 52 are arranged on the bottom surface of the base member 11 so as to be exposed (see FIG. 5). These electrodes 52, 52 are used for charging the nickel-cadmium battery 49 and can come in contact with charging terminals 53, 53 provided in the remote controller device 3, described later.

The lid 12 is formed into a disc shape or a polygonal shape in which the center is opened, and a pair of hangover pieces 55, 55 which protrude inward are formed on the inner edge portion of the lid 12 so as to be opposed to each other. The inner edge portions of the hangover pieces 55 have a circular arc shape, and their size is set so that the shaft support 10 can be fitted therein. In a state that the lid 12 overlaps the base member 11, flat countersunk head screws 56 are screwed into screw holes 57 of the base member 11 so that the lid 12 can be fixed to the base member 11 while the circuit unit 48 and the nickel-cadmium battery 49 can be accommodated therein.

The attack ring 13 is made of a disc shaped member with a circularly opened center, and is formed with protrusions 60 outward, which attack toy tops of competitors, at equal intervals from the peripheral surface thereof. The inside of the opening portion is formed with a pair of hangover pieces 61, 61 in an opposed state, and inner edge portions of the hangover pieces 61, 61 have a circular arc shape and their size is set that the shaft support 10 can be fitted therein. An engagement piece 62 is protrusively formed on a center of the inner edge portion of the hangover piece 61. A distance between the engagement pieces 62 is set so as to be approximately equal to a distance between the notch portions 16 of the shaft support 10.

Figure 6:
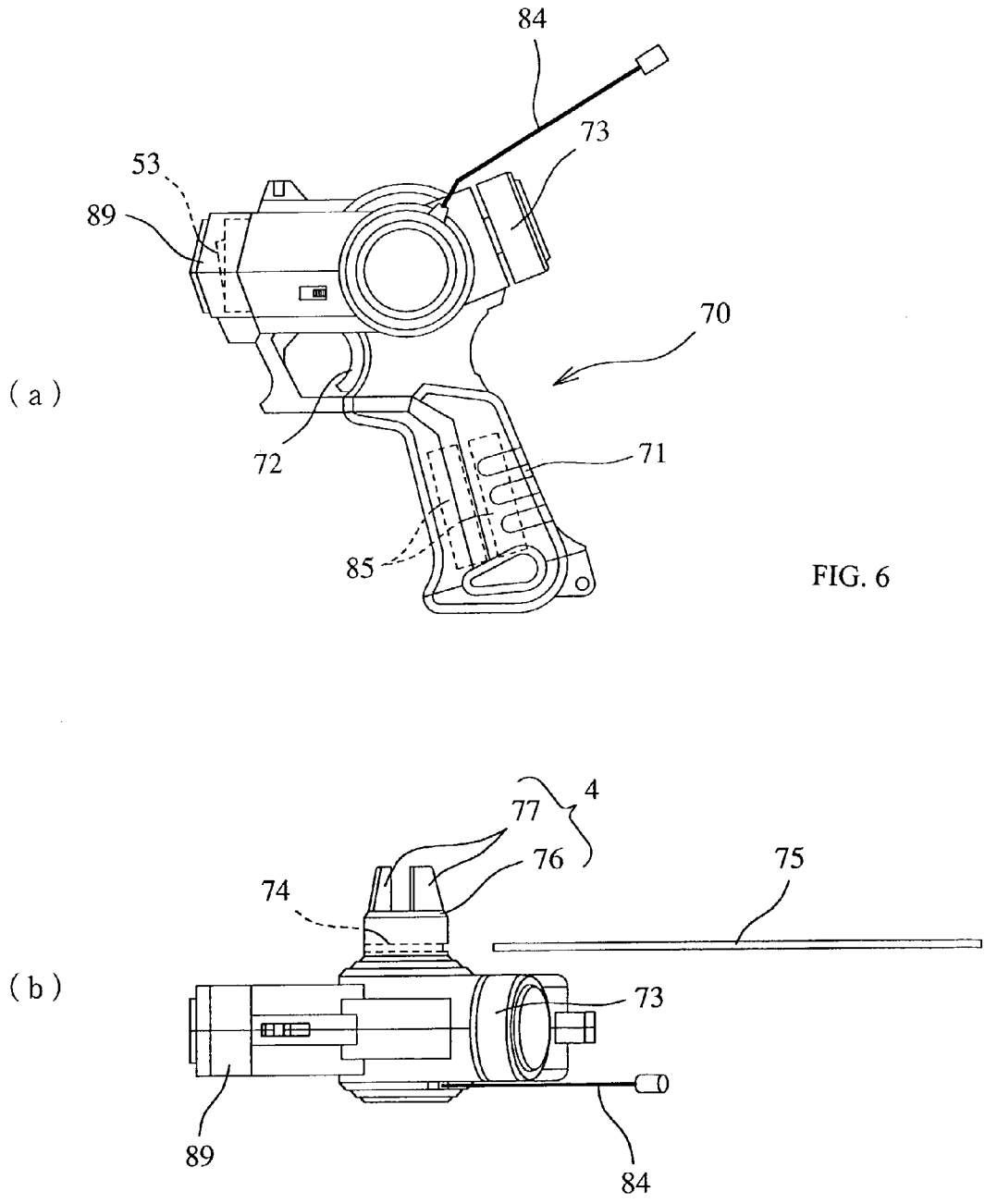
FIGS. 6(*a*) and 6(*b*) are a front view and a plan view of a remote controller device.

FIGS. 6(*a*) and 6(*b*) show a front view and a plan view of the remote controller device 3. The remote controller device 3 is formed into a pistol shape having a grip portion 71 so that a device main body 70 can be gripped by one hand, and is provided with a trigger shaped operating section 72 which can be pulled. Moreover, a dial 73 is arranged on a backward end of the remote controller device 3 so as to be capable of revolving. In the remote controller device 3, when the dial 73 is revolved to the right and simultaneously the operating section 72 is pulled, a control signal which causes the motor 20 to be rotated to the right is generated, and when the dial 73 is revolved to the left and simultaneously the operating section 72 is pulled, a control signal which causes the motor 20 to be rotated to the left is generated.

Further, the remote controller device 3 is provided with the starter mechanism 4 which gives an initial spin to the toy top 1. This starter mechanism 4 may be composed of a publicly-known starter mechanism. The starter mechanism 4 is constituted so that a gear (not shown) is engaged with a rack belt 75 inserted into a through hole 74 penetrating the right side surface of the device main body 70 in a backward and forward direction, the gear is rotated by the pulling operation of the rack belt 75, and a rotary plate 76 arranged on the side surface of the device main body 70 is rotated at high speed by the linkage of the gear. When the rack belt 75 is completely pulled out of the device main body 70, a ratchet, not shown, is engaged with the gear so that the rotation of the rotary plate 76 is stopped instantly.

Two nipping pieces 77, 77 for nipping the toy top 1 are protrusively formed on the rotary plate 76, and the rotary plate 76 is rotated by the rack belt 75 so that the nipped toy top 1 can be rotated at high speed. When the rotary plate 76 is stopped suddenly, the toy top 1 which spins due to inertia is disengaged from the nipping pieces 77 so as to spin independently.

FIGS. 7(*a*) and 7(*b*) are block diagrams showing an electric structure of the toy top 1 and the remote controller device 3. A control circuit 80 generates a control signal for remotely controlling the rotation of the motor 20 of the toy top 1. The control circuit 80 generates a control signal for regularly and reversely rotating the motor 20 by means of a switch 81 which is turned ON by pulling the trigger-like operating section 72, switches 82 and 83 which are turned ON by revolving the dial 73 arranged on the back end of the device main body 70 to the right and left and a combination of the switch 81 and the switches 82 and 83, and transmits the generated control signal from an antenna 84.

A burst signal transmitted from the remote controller device is received by an antenna 86 of the toy top 1 and is converted into a signal for controlling a motor driver 88 by a receiving circuit 87, and the regular and reverse rotation of the motor 20 is controlled by a motor driver 88.

The transmission and reception of the control signal uses radio control, but may instead use infrared remote control using an infrared LED on the transmission side and a light receiving element (photodiode) on the receiving side instead of the antenna.

When a cover 89 on the front surface of the main body is opened, the charging elements 53, 53 are exposed, and when the electrodes 52, 52 provided on the rear surface of the toy top 1 are brought into contact with the charging elements 53, 53, the nickel-cadmium battery 49 of the toy top 1 can be charged by a battery 85 of the remote controller device 3.

According to the remote control toy top having the above structure, after the nickel-cadmium battery 49 of the toy top 1 is charged, the battery 49 is set in the remote controller device 3, and then the rack belt 75 is inserted fully into the through hole 74 of the device main body 70. Thereafter, the remote controller device 3 is kept in a laid down state so that the toy top 1 is opposed to a game surface 5 of the stadium 2, and the rack belt 75 is pulled strongly.

Since the rotary plate 76 rotates at high speed due to the linkage of the pulling operation of the rack belt 75, the toy top 1 nipped by the nipping pieces 77, 77 provided on the rotary plate 76 spins integrally with the rotary plate 76. When the rack belt 75 is completely pulled out of the through hole 74 of the device main body 70, the rotary plate 76 stops suddenly. For this reason, the toy top 1 which spins due to inertia is spinning and simultaneously detached from the nipping pieces 77, 77 to drop onto the game surface 5 of the stadium 2 so as to spin on the game surface 5 continuously.

Figure 8:
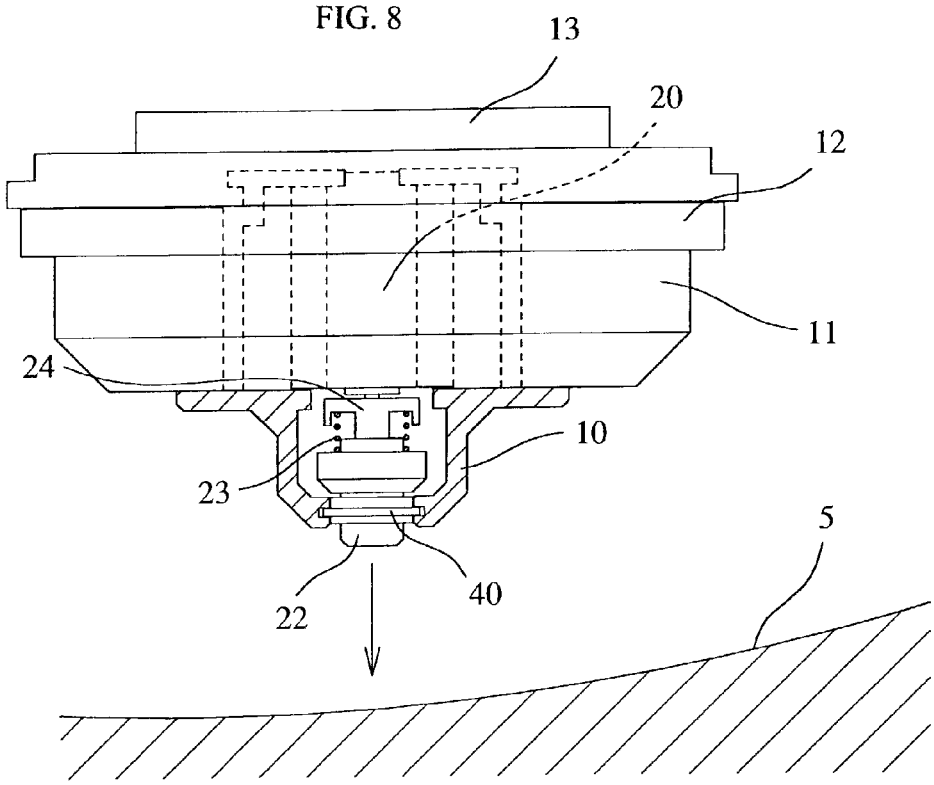
FIGS. 8(*a*) and 8(*b*) are cross-sectional views of a main section showing states in which the toy top drops onto a stadium.
Figure 8:
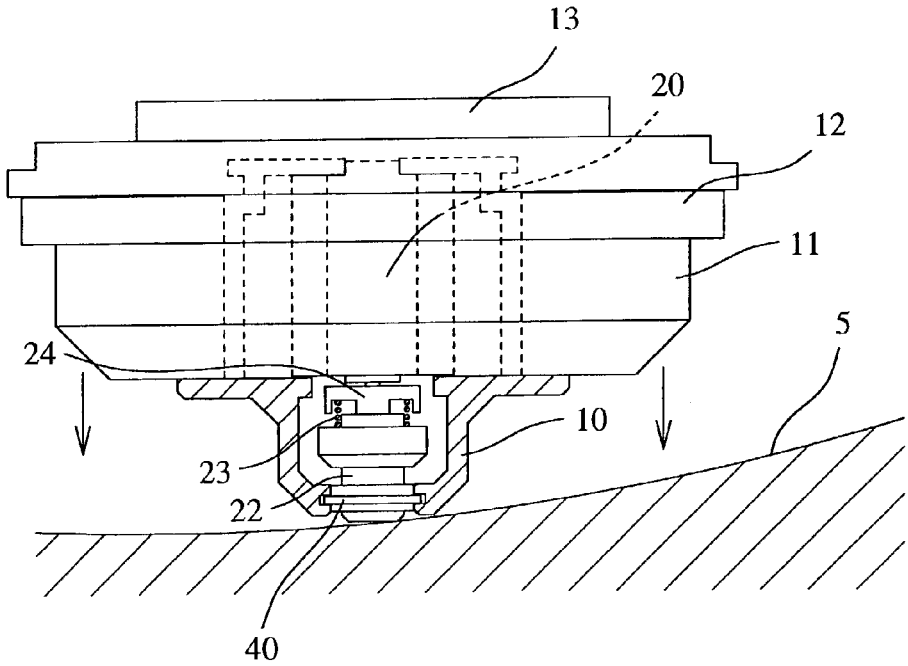

When the toy top 1 drops onto the game surface 5, the entire weight of the toy top 1 is applied to the shaft body 22 and thus the shaft body 22 receives a strong impact, but the coil spring 23 absorbs the impact so that the impact is not transmitted directly to the motor shaft 37 of the motor 20. For this reason, a trouble such that the motor 20 is damaged by the impact can be precluded (see FIGS. 8(*a*) and 8(*b*)).

Although the toy top 1 spins on the game surface 5 of the stadium 2 which is curved into a concave mirror shape, the forward end of the shaft body 22 is formed flat and the toy top 1 stands vertically due to a gyroscope effect. For this reason, a corner of the forward end of the shaft body 22 comes in contact with the game surface 5, and the forward end peripheral edge of the shaft body 22 functions like a small wheel, so that the toy top 1 is spinning and simultaneously moves (revolves) on the game surface 5 so as to draw a circular arc. A speed of rotation is higher, the toy top 1 revolves so as to draw a larger circular arc on the game surface 5.

At this time, in the case of the toy top 1 which spins to the right, when the trigger 72 is pulled in a state tat the dial 73 is revolved to the right, a control system which rotates the motor 20 to the Tight (the rotating direction of the motor 20 is the same as that of the toy top) is generated only during the time while the trigger 72 is being pulled. For this reason, the shaft body 22 rotates to the right at high speed due to the linkage of the motor shaft 37 of the motor 20, and the spinning speed of the toy top 1 increases, and thus the toy top 1 revolves in the counterclockwise direction at higher speed and along a larger diameter so as to move towards the outside of the game surface 5 (see FIG. 9(*a*)).

Meanwhile, when the trigger 72 is pulled in the state that the dial 73 is revolved to the left, a control signal which rotates the motor 20 to the left (the rotating direction of the motor 20 is opposite to that of the toy top) is generated only during the time while the trigger is being pulled. For this reason, the shaft body 22 rotates to the left due to the linkage of the motor shaft 37 of the motor 20, and the toy top 1 revolves along a small diameter so as to move towards the center of the game surface 5 (see FIG. 9(*b*)).

When the spinning speed of the toy top is set to be the same as the reverse rotating speed of the rotary shaft body by the operation of pulling the trigger 72, the movement stops. When the reverse rotating speed of the rotary shaft body is higher than the spinning speed of the toy top, the toy top can be revolved to the right.

In addition, in the case of the toy top in which the initial spinning is to the left, when the trigger 72 is pulled in the state that the dial 73 is revolved to the left, a control signal which rotates the motor 20 to the left (rotating direction of the motor 20 is the same as that of the toy top) is generated only during the time while the trigger 72 is being pulled. For this reason, the shaft body 22 is rotated to the left at high speed by the linkage of the motor shaft 37 of the motor 20 so that the toy top can be revolved in the clockwise direction along a large diameter. When the trigger 72 is pulled in the state that the dial 73 is revolved to the right, a control signal which rotates the motor 20 to the right (the rotating direction of the motor 20 is opposite to that of the toy top) is generated only during the time while the trigger is being pulled. For this reason, the shaft body 22 rotates to the right due to the linkage of the motor shaft 37 of the motor 20 and the toy top 1 revolves along a small diameter so as to move towards the center of the game surface 5.

As mentioned above, the rotation of the shaft body 22 of the toy top 1 spinning on the game surface 5 of the stadium 2 is controlled, so that the performance characteristics can be changed in such a manner that the toy top 1 which revolves and moves on the game surface can be moved towards the outside of the game surface or towards its center. For this reason, an attack of a competitor's toy top 1' can be avoided or an attack can be made on the competitor's toy top 1' due to a player's own free will, and thus the player can enjoy the toy top game in which the player's will is reflected. As a result, the toy top of the present invention makes toy top games more interesting and enjoyable than the conventional toy top games in which players cannot affect the course of the games.

According to the present invention, the shaft body of the toy top is provided to the motor shaft of the motor provided in the toy top, and the motor is rotated regularly and reversely by remote operation of the remote controller device, so that a player's will can be reflected in the performance characteristics of the toy top so that the toy top game is more interesting and enjoyable than the conventional toy top games in which players cannot affect the course of the games.

According to the preferred embodiment of the invention, since the buffer mechanism, which absorbs the impact applied to the shaft body when the toy top drops onto the stadium, is provided, the impact can be prevented from being applied to the motor via the shaft body so that damage to the motor can be precluded.

According to the embodiment of the invention, when the toy top competes against competitors' toy top on the stadium whose upper surface is curved into a concave mirror shape, the toy top can be revolved and thus more effective performance characteristics can be displayed.

According to another embodiment of the invention, the starter mechanism of the toy top is provided with the remote controller device, so that an initial spin can be given to the toy top and thus the toy top can be spun without preparing an additional starter apparatus.

According to the further embodiment of the invention, since the attack ring can be attached to the toy top, the attack ring can be used effectively by changing the performance characteristics, thereby allowing the toy top to compete against competitors' toy tops advantageously.

DESCRIPTION OF REFERENCE NUMERAL

1 toy top
2 stadium
3 remote controller device
20 motor
22 shaft body
25 buffer mechanism
37 motor shaft

What is claimed is:

1. A remote control toy top comprising a toy top having a toy main body and a shaft body and a remote controller device for changing performance characteristics of said toy top by means of a remote operation, wherein:

(a) said toy top is provided with a motor having a rotatable motor shaft and said motor shaft of said motor is rotated regularly and reversely by a control signal generated from said remote controller device; and (b) said shaft body of said toy top is axially supported on a bottom portion of said toy main body so as to be capable of freely rotating and rotates in cooperation with said motor shaft of said motor, wherein said shaft body of said toy top includes a buffer mechanism for absorbing an impact in an up-down direction and permitting the shaft body to move relative to said motor shaft in said up-down direction.

2. The remote control toy top according to claim 1, further comprising a stadium device, said stadium device being formed by curving its upper surface into a concave mirror shape, wherein said toy top competes against other toy tops in said stadium device.

3. The remote control toy according to claim 1, wherein the remote controller device is provided with a starter mechanism for giving an initial spin to said toy top and for releasing the toy top to contact a support surface for rotation.

4. The remote control toy top according to claim 1, wherein said toy top is provided detachably with an attack ring on an upper surface of the toy main body, said attack ring being provided with at least two hangover portions protrusively formed on said attack ring at equal intervals in a peripheral direction.

5. The remote control toy according to claim 1, wherein said buffer mechanism includes a holding member operatively connected to said rotatable motor shaft;

a spring mounted in said holding member and said shaft body movable relative to said holding member and biased to extend away from said holding member by said spring.

6. The remote control toy according to claim 5 further including a shaft support connected to said main body and journally said shaft body to move into and out of said shaft support.

7. A remote control toy top comprising:

a housing member that can be rotated;

a shaft body movably attached to the housing member and providing a contact surface when the housing member is rotating on a supporting surface; and a driver member connected to the shaft body to move the shaft body independent of a rotation of the housing member, wherein the shaft body is biased to extend from the housing member and is movable towards and away from the housing member to absorb an impact when the housing member is dropped on the supporting surface.

8. The remote control toy top of claim 7 wherein the shaft body is movably attached to rotate in one of a clockwise and a counter-clockwise movement, movement of the shaft body in a direction of rotation that is in the same direction of rotation as the housing member will steer the top in one direction while movement in a direction of rotation that is counter to the direction of rotation of the housing member will steer the housing member in another direction.

9. The remote control toy top of claim 8 where the driver member is an electric motor mounted within the housing member.

10. The remote control toy top of claim 9 further including a rechargeable battery mounted in the housing member and connected to the electric motor.

11. The remote control toy top of claim 10 further including a pair of electrical contacts connected to the rechargeable battery that are accessible from the exterior of the housing member for electrically recharging the rechargeable battery.

12. The remote control toy top of claim 8 further including a receiver circuit mounted in the housing member and operatively connected to the driver member for providing control signals to the driver member from a transmitter circuit unit remote from the toy top.

13. The remote control toy top of claim 12 further including a mechanical unit for manually rotating the housing member independent of the driver member.

14. The remote control toy top of claim 12 further including a controller unit with the transmitter circuit unit and a user input control unit to send control signals to the driver member.

15. The remote control toy top of claim 14 further including a pair of terminals on the controller unit, a pair of electrical contacts on the housing member and a rechargeable battery in the housing member electrically connected to the pair of electrical contacts, wherein the terminals on the controller unit can be removably attached to the electrical contacts to recharge the rechargeable battery.

16. The remote control toy top of claim 14 further including a mechanical unit mounted on the controller unit for manually rotating the housing member.

17. A remote control toy top assembly comprising:

a housing member that can be manually rotated to spin;

a shaft body that can rotate relative to the housing member and can contact and traverse across a corresponding support structure, the shaft body is biased by a buffer mechanism to extend from the housing member and is movable towards and away from the housing member to absorb an impact with the support structure when dropped; and a driver member mounted in the housing member for operatively rotating the shaft body in one of a clockwise and a counter-clockwise movement independent of the manual rotation of the housing member whereby rotation of the shaft body in a direction of rotation that is counter to any manual rotation of the housing member will steer the housing member in a first direction while rotation in the same direction of any manual rotation will steer the housing member in a second direction opposite to the first direction.

18. The remote control toy top assembly of claim 17 further including a remote controller unit for providing control signals to the driver member to steer the housing member.

19. The remote control toy top assembly of claim 18 wherein the remote controller unit includes a mechanical unit for manually rotating the housing member and releasing the rotating housing member to impact the shaft body with the support structure.

20. The remote control toy top assembly of claim 19 wherein the driver member is a reversible electric motor.

* * * * *